US005119545A

United States Patent [19]

Anderson et al.

[11] Patent Number: 5,119,545

[45] Date of Patent: Jun. 9, 1992

[54] APPARATUS FOR SERVICING LOOM FEEDER PLATE ASSEMBLY

[75] Inventors: Douglas M. Anderson; James R. Miller, both of Greenville, S.C.

[73] Assignee: Precision Research and Development, Inc., Greenville, S.C.

[21] Appl. No.: 579,703

[22] Filed: Sep. 10, 1990

[51] Int. Cl.[5] ..... B23P 11/00

[52] U.S. Cl. ..... 29/243.54

[58] Field of Search ..... 29/243.5, 243.53, 243.54, 29/243.55, 283, 254, 275, 283.5, 402.03, 525, 526, 251; 72/481, 453.19; 59/7, 11; 408/115

[56] References Cited

U.S. PATENT DOCUMENTS

| | | | |
|---|---|---|---|
| 2,816,465 | 12/1957 | Honnef | 408/115 |
| 3,234,634 | 2/1966 | Johnson et al. | 29/243.54 |
| 4,637,113 | 1/1987 | Cook | 29/283 |
| 4,918,798 | 4/1990 | Reed | 29/243.53 |
| 4,949,446 | 8/1990 | Kuwica | 29/243.53 |

*Primary Examiner*—Robert C. Watson

*Attorney, Agent, or Firm*—Bailey & Hardaway

[57] ABSTRACT

A fixture is illustrated for servicing a loom feeder plate assembly, having a feeder gripper beneath a guide block riveted to a plate, providing a plurality of work stations for carrying out the servicing operations.

5 Claims, 2 Drawing Sheets

APPARATUS FOR SERVICING LOOM FEEDER PLATE ASSEMBLY

BACKGROUND OF THE INVENTION

This invention relates to apparatus for servicing a loom feeder plate assembly wherein a feeder gripper, riveted to the plate, is carried beneath a guide block.

A Sulzer loom utilizes a loom feeder plate assembly having a feeder gripper for feeding yarn from a loom feeder through the guide block positioned upon the feeder plate to a projectile for insertion of the filling yarn. The elements of the assembly carried by the plate are sometimes broken or worn out during extended use requiring servicing, including replacement. The steps of removal of the old rivets, positioning the guide block, positioning of new rivets together with bradding or riveting followed by the installation of the feeder gripper beneath the guide block constitute a difficult manual operation. Although this operation is typically performed by a single operator, the contortions required to carry out the various steps result in frustration to the operator and frequent damage to the various parts of the assembly and to the plate.

Accordingly, it is an object of the invention to provide a fixture capable of positively positioning the parts for readily performing the various operations required for servicing a loom feeder plate assembly such as is utilized in connection with a Sulzer loom.

Another important object of the invention is to provide a fixture for servicing a riveted assembly having a punch guide platform for guiding a punch having a cylindrical member and a straight shank for removing rivets through aligned openings in a receptacle or recess provided within a base member or fixture.

Still another object of the invention is the provision of a single fixture utilizing a special punch for removing rivets and having spaced pairs of aligned posts for positioning the plate carried assembly for successive servicing operations.

SUMMARY OF THE INVENTION

It has been found that a fixture may be provided which includes a number of pairs of aligned posts and which utilizes a punch guide platform carried by one of the pairs of posts for carrying out sequential service operation including rivet removal, guide block replacement with rivets, together with positioning of a feeder gripper beneath the lateral projections of the guide block. The fixture is provided with recesses for receiving the feeder gripper and the guide block for rivet removal as well as the subsequent bradding of new rivets in order to avoid damage to the assembly and to the plate. The straight shank carried by the guide member of the rivet punch is especially adapted for use with the punch guide platform which is positively positioned above the plate and the assembly carried thereby upon guiding posts to assure proper alignment for rivet removal.

While apparatus is described in connection with the servicing of a loom feeder plate assembly such as is carried upon a Sulzer loom, the fixture hereof may be utilized for similar servicing of other assemblies with only slight modification.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a fixture for servicing a loom feeder plate assembly having a feeder gripper beneath a guide block riveted to a plate. A base member has a flat upper surface A for carrying spaced elements for positioning and receiving the loom feeder plate assembly for servicing. Spaced elements including spaced pairs of vertical aligned posts B, C and D are carried by the base member and extend upwardly therefrom. At least one recess is provided within the base member for receiving the feeder gripper and guide block carried by the plate. A punch guide block E is carried by an adjacent pair of vertical aligned posts for positioning same above the plate with aligned punch guide openings aligned with rivets attaching the guide block to the plate. At least one additional of the recesses within the base member receives the feeder gripper and guide block carried by the plate positioned by another of the pairs of aligned posts.

Figure 3:
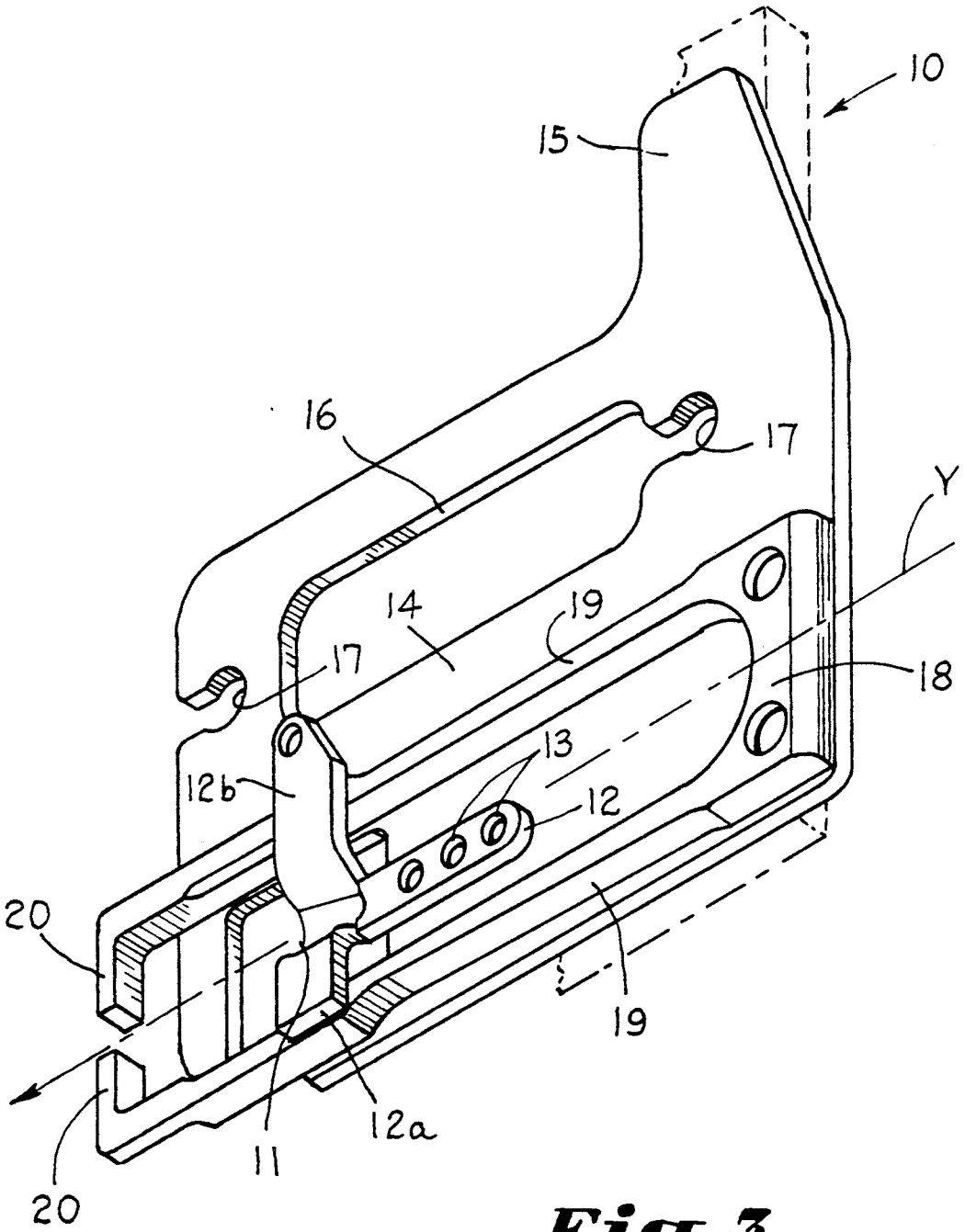
FIG. 3 is a perspective view, at an enlarged scale, illustrating a loom feeder plate assembly attached to the slide piece of a loom for receiving yarn from a yarn feeder.

FIG. 3 illustrates the feeder plate carried upon the slide piece of a loom broadly designated at 10 receiving the yarn Y through the guide channel 11 in the guide platform which has a central riveted portion 12 for receiving rivets through the spaced openings 13 carried therein. The plate includes a substantially rectangular portion 14 which has an ear 15 positioned in FIG. 3 on the slide piece as pointing upwardly on the right hand end of the plate. The plate has the usual hole 16 therein and an opening 17 at each end for receiving screws (not shown) for positioning the plate upon the slide piece of the loom 10.

The guide block 12 includes ears **12*a* and 12*b* which project laterally on the side of the yarn channel 11. A feeder gripper 18 has a pair of spring arms 19 which carry opposed gripper members 20** which project inwardly for gripping and releasing the yarn as it is fed to the projectile which serves as a shuttle like member in a Sulzer loom.

The fixture which includes a block carrying the base member is illustrated as providing an upper surface A which is divided essentially into three sections each of which includes a pair of upright transversely spaced aligned posts for positioning the guide block and the plate 14 in various positions during the several servicing operations.

Figures 1, 2:
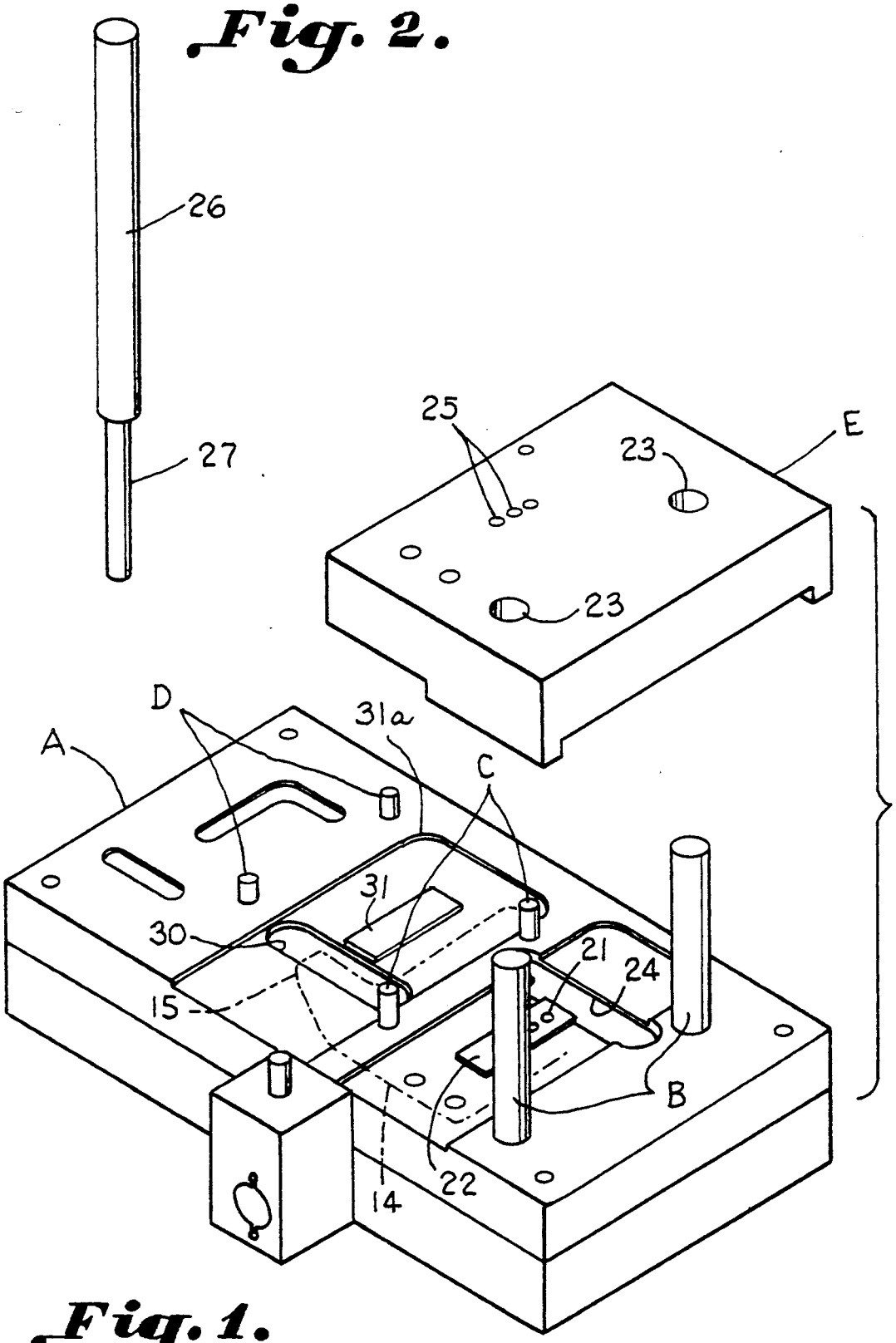
FIG. 1 is a perspective view of a fixture constructed in accordance with the present invention having a punch guide platform positioned for reception upon posts for positioning a punch guide platform above the loom feeder plate assembly.
FIG. 2 is a perspective view illustrating a rivet removal punch constructed in accordance with the present invention.

The plate 14 is illustrated in broken lines in FIG. 1 with the assembly members facing downwardly and the ear 15 pointing upward on the left. This permits the rivets within the holes 13 of the guide block to be aligned with spaced openings 21 carried within backing member 22. The punch guide platform has a pair of openings 23 receivable upon the posts B for positioning same in superimposed relation, the plate 14 being positioned as described as the posts C maintain alignment through engagement in the end openings 17. It will be noted that a recess opening, 24 with the recess 24*a*, is provided opposite the backing member 22 to receive the opposed ears 12*a* and 12*b* of the guide block to avoid damage to same during servicing.

The punch as illustrated in FIG. 2 is inserted into the spaced openings 25 which are in alignment with the openings 21. The punch is struck so as to remove the existing rivets. It will be noted that the punch includes a cylindrical member 26 which carries a straight shank 27 for accommodation within the guides 25. The assembly is then moved to an assembly portion at the other end of the base member which has posts D for reception within the openings 17 positioning the plate in upwardly facing position as in FIG. 3 with the ear 15 extending upwardly on the right.

The guide block 12 is positioned with the rivets being inserted into the openings 13. The plate is then inverted in the anvil section with the assembly in down position with the receptacle opening 30 within the recess 30*a* accommodating the guide block for riveting upon the anvil block 31.

The plate is again turned right side up and positioned upon the guide posts D for completing the assembly by inserting the feeder gripper beneath the laterally extending ears 12 of the guide block. This is conveniently accomplished by utilizing pliers having jaws which move outwardly when the handle members are compressed. For further ease of operation the gripper of the pliers should be provided with flats for engagement with an inner surface of the spring arms 19 to separate the jaws 20.

It is thus seen that an apparatus has been provided which includes a fixture for servicing a loom feeder plate assembly having a feeder gripper and guide block. Additional convenience may be afforded by utilizing a modified structure which incorporates the spaced vertical pairs of guide posts and the several recesses for carrying a plate and other assembly members in position for the various servicing operations.

While a preferred embodiment of the invention has been described using specific terms, such description is for illustrative purposes only, and it is to be understood that changes and variations may be made without departing from the spirit or scope of the following claims.

What is claimed is:

1. A fixture for servicing a loom feeder plate assembly having a feeder gripper beneath a guide block riveted to a plate comprising:

a base member having a continuous, substantially planar upper surface for carrying spaced elements for positioning and receiving said loom feeder plate assembly for servicing;

said spaced elements including spaced pairs of vertical aligned posts carried by said base member and extending upwardly therefrom;

a recess within said base member for receiving said feeder gripper and guide block carried by said plate;

a punch guide platform carried by an adjacent pair of vertical aligned posts for positioning same above said plate with aligned punch guide openings aligned with rivets attaching said guide block and feeder gripper to said plate;

a receptacle carried by said base having openings receiving punched out rivets opposite said guide openings; and at least one additional recess within said base member for receiving said feeder gripper and guide block carried by said plate positioned by another of said pairs of aligned posts.

2. The structure set forth in claim 1 including a rivet removal punch having a cylindrical member receivable in said punch guide platform, and a straight shank for engaging said rivets.

3. The structure set forth in claim 2 wherein said punch guide platform is carried adjacent one end of said base, and including an assembly station carried by an opposite end of said base.

4. The structure set forth in claim 3 including an anvil station carried by an intermediate portion of said base having a recess accommodating said guide block during riveting thereof.

5. A fixture for servicing a plate carried assembly having a block riveted to the plate comprising:

a base member having a continuous, substantially planar upper surface for carrying spaced elements for positioning and receiving said plate carried assembly for servicing;

said spaced elements including spaced pairs of vertical aligned posts carried by said base member and extending upwardly therefrom for positioning said plate carried assembly with said block up and in inverted position;

a recess within said base member for receiving said block carried by said plate in inverted position;

means positioning said plate with rivets above aligned punch guide openings; and an anvil station carried by said base.

* * * * *